US005564649A

United States Patent [19]

von Hoessle et al.

[11] Patent Number: 5,564,649

[45] Date of Patent: Oct. 15, 1996

[54] APPARATUS FOR THE REMOTE CONTROL OF MISSILES OR TORPEDOES

[75] Inventors: Wolfgang von Hoessle, Riemerling; Ernst-August Seiffarth, Taufkirchen, both of Germany

[73] Assignee: Daimler-Benz Aerospace AG, Germany

[21] Appl. No.: 417,612

[22] Filed: Apr. 5, 1995

[30] Foreign Application Priority Data

Apr. 27, 1994 [DE] Germany ..... 44 14 737.6

[51] Int. Cl.[6] ..... F41G 7/32

[52] U.S. Cl. ..... 244/3.12; 114/21.1; 102/504

[58] Field of Search ..... 244/3.12; 102/504; 114/21.1

[56] References Cited

U.S. PATENT DOCUMENTS

| | | | |
|---|---|---|---|
| 3,265,023 | 8/1966 | Hollingsworth, Jr. et al. | 114/21.1 |
| 4,573,647 | 3/1986 | Laten et al. . | |
| 5,022,607 | 6/1991 | Schotter | 244/3.12 |
| 5,031,997 | 7/1991 | Redford et al. . | |

FOREIGN PATENT DOCUMENTS

| | | |
|---|---|---|
| 0337254A2 | 10/1989 | European Pat. Off. . |
| 0342525A2 | 11/1989 | European Pat. Off. . |
| 0358808A1 | 3/1990 | European Pat. Off. . |
| 0404367A2 | 12/1990 | European Pat. Off. . |
| 0443623A1 | 8/1991 | European Pat. Off. . |
| 0504049 | 9/1992 | European Pat. Off. . |
| 3818840 | 6/1988 | Germany . |
| 1016410 | 1/1966 | United Kingdom . |

*Primary Examiner*—Michael J. Carone
*Assistant Examiner*—Christopher K. Montgomery
*Attorney, Agent, or Firm*—Evenson, McKeown, Edwards & Lenahan P.L.L.C.

[57] ABSTRACT

The invention provides an apparatus for the remote control of missiles or torpedoes launched from a launching container, by means of a cable of which a portion is wound onto a supply reel connected with the launching and of which the other portion is wound onto a supply reel in the missile or the torpedo. The supply reel in the launching container is arranged on the forward end of the container, and the supply reel in the missile or torpedo is arranged on the rearward end of the missile or torpedo. The cable section between the two supply reels, before the launching of the missile or torpedo, is fastened along the major portion of its length on the interior wall of the launching container, by means of a gluing arrangement which consists of a material whose combustion temperature is at least by 800° C. lower than the melting temperature of the optical waveguide, or by means of a flexible clamping arrangement whose holding force can be adjusted.

13 Claims, 1 Drawing Sheet

APPARATUS FOR THE REMOTE CONTROL OF MISSILES OR TORPEDOES

BACKGROUND AND SUMMARY OF THE INVENTION

The present invention relates to an apparatus for remote control of missiles or torpedoes launched from a launching container, by means of a cable transmitting the control data. In such systems, a portion of the cable is wound on a first supply reel connected with the launching container, and the remainder of the cable is wound on another supply reel in the missile or the torpedo. The first supply reel is arranged in the forward end of the launching container, while the other is mounted at the rearward end of the missile or torpedo, and the cable section between the two supply reels before the launching of the missile or torpedo is fastened along the major portion of its length on the interior wall of the launching container.

Because of their high transmission band width and very low damping, optical waveguides are preferred for use in the remote control of missiles or torpedoes. Such waveguides make it possible to transmit image and condition data in real time from the missile to the ground and, at the same time, transmit steering and switching commands in the opposite direction. However, because a glass fiber is used for the optical waveguide, particularly in the case of a missile, considerably more difficulties must be overcome than were previously encountered when guidance wires made of a ductile material were used. Damage to the glass, such as microcracks in the glass surface or microscopic impurities will very rapidly result in glass breakage when subjected to stress, interrupting the transmission, which is tantamount to losing the missile or the torpedo.

An important prerequisite for the use of optical waveguides wound onto supply reels for the remote control of missiles and torpedoes is therefore the avoidance of high stress when withdrawing the optical waveguides.

When the missile or the torpedo is launched, an optical waveguide, like a guidance wire, is unwound from the reel situated in the rear of the missile or the torpedo, and will therefore have zero velocity relative to the surrounding air or water. Thus, theoretically, except for the stress caused by the unwinding operation, no forces will act upon the optical waveguide. At the start of the unwinding operation from the supply reel on the missile or torpedo, the forces which counter the unwinding tensile forces are absorbed by the holding device for the optical waveguide at the launching system. However, as the flight progresses, the pull at the launching point is reduced because the frictional forces of the air or of the water alone are sufficient to unwind the coil, and the portion of the transmission path which is closer to the launching system will slowly slacken.

However, if the launching system, such as a launching container, moves during the flight of the missile or the travel of the torpedo, the slackening of the optical waveguide will generally not be sufficient to accommodate the move, and a length of optical waveguide required for the movement of the launching system must be made available by way of a compensating reel at the launching system. If the launching container of the launching system is situated on a vehicle, an airplane, a helicopter or a high-speed boat, it is possible for large movements to occur during the flight or travelling time, and thus, fairly large lengths may possibly be wound off the compensating reel.

The launching container, from which the launch takes place, is normally provided as a protection against outside environmental influences during handling and transport of the missile or torpedo. Since, during the launch, after leaving the launching container, the missile or the torpedo, if possible, should not pancake, a relatively high acceleration is required. So that the tensile load on the optical waveguides does not become too high during acceleration phase, it is advantageous to start the unwinding operation with the first movement of the missile. That is, if possible, there should be no slack between the fixed point in the launching container and the first winding of the reel. In addition, the fixed point in the container should be selected such that the pulling direction between the fixed point and the outlet gap of the optical waveguide out of the reel extends in a straight line and in the direction of acceleration of the missile or the torpedo.

Since the supply reel for the optical waveguide is situated on the rear of the missile or torpedo, the coupling point (that is, the fixed point) of the optical waveguide must be in the inside rear in the container. This necessity, however, has been found to present problems in many cases. In particular, the following disadvantages may be mentioned:

- Sharp edges in the interior of the container (for example, launcher rails or plug connections) may damage the very sensitive optical waveguide. This is particularly true when the optical waveguide is also impacted by the exhaust plume of the booster which penetrates the launching container;
- If the missile or the torpedo is deflected from the original launching direction after leaving the launching container, the optical wave guide is bent on the forward container edge. Particularly when the forward container edge is not softly rounded, sharp edges may damage the optical waveguide.
- If the compensating reel is mounted in the rear in the container, during the unwinding of additional lengths from the compensating reel, the optical waveguide may not only be bent by the forward edge of the launching container, but may also be pulled over a possibly sharp edge and therefore torn off.

It has therefore been suggested that the coupling point for the optical waveguide (or a guidance wire) be located in the forward end of the launching container, or even located outside of the container. For this purpose, U.S. Pat. No. 5,031,997 describes a missile launching container in which the supply reel is arranged at the forward end of the container, and the supply reel in the missile is arranged on the rearward end of the missile. That part of the optical waveguide which, before the launching of the missile, extends between the two supply reels, is glued along the largest portion of its length to the shell of the missile. During the launch, the optical waveguide is torn out of the glued connection by the forward movement of the missile until it is finally unwound from the supply reel. Although this arrangement has the advantage that the optical waveguide remains outside the operating range of the exhaust plume during the launch, it has the disadvantage that, as the result of the launching acceleration, the missile has already reached a high velocity before the start of the withdrawal from the reel, and hence the optical waveguide is subjected to extremely high acceleration forces.

Known missiles with similar arrangements (such as MILAN) already have a velocity of approximately 80 m/s, at the start of the wind-off. At this velocity, guidance wires with ductile electric conductors made of copper and a ductile polyester covering can still be reeled off without tearing despite the abrupt, shocklike start. However, the use of optical waveguides is not possible in the case of such jerky peak loads, because glass with its very high modulus of elasticity is virtually not ductile and the jerk is not absorbed. Thus, only an optical waveguide which is reinforced by materials of a still higher modulus of elasticity, such as carbon fibers or kevlar fibers, may be considered for such a use.

It is an object of the present invention to provide a launch system which can use unreinforced optical waveguides for the remote control of missiles or torpedoes launched from a launching container, with the coupling point displaced toward the front of the launching container so that the use of an equalizing reel is possible, and the unwinding operation starts as early as with the movement of the missile or of the torpedo.

This object is achieved according to the invention by a novel arrangement for fastening the optical waveguide on the interior of the launching container, using a material which easily releases the waveguide upon launch of the missile or torpedo.

In a first embodiment of the invention, the waveguide is fastened by an adhesive material whose combustion temperature is at least 800° C. lower than the melting temperature of the optical waveguide.

In another embodiment of the invention, the optical waveguide is fastened by a flexible clamping arrangement whose holding force can be adjusted.

By fastening the cable section between the two supply reels on the interior wall of the launching container, in a manner which is advantageously somewhat tighter than the gluing of the individual windings of the optical waveguide on the supply reel connected with the missile or the torpedo, it can be ensured that the unwinding operation takes place with the movement of the missile or of the torpedo. When the missile or torpedo has moved away from the launching container so far that the atmospheric friction or the catching of the optical waveguide on an obstacle, such as a tree top, no longer allows a feeding of additional lengths from the missile, and the carrier vehicle moves, this glued arrangement is torn open, starting in the direction to the forward end of the launching container, to the compensating reel (or supply reel) possibly provided there.

In the selection of a suitable adhesive material, care must be taken that the glued arrangements can be stored on a long-term basis without significant change of the mechanical holding force, and that the holding force remains the same under all environmental conditions. That is, in a given temperature range, the bending radius of the optical waveguide must not become too small during the tearing-open of the fastening in order to avoid a breakage, and the fastening must be able to withstand the intermittent high temperatures of the gas jet in the case of a booster, but then can definitely burn-up.

Other objects, advantages and novel features of the present invention will become apparent from the following detailed description of the invention when considered in conjunction with the accompanying drawings.

DETAILED DESCRIPTION OF THE DRAWINGS

Figure 1:
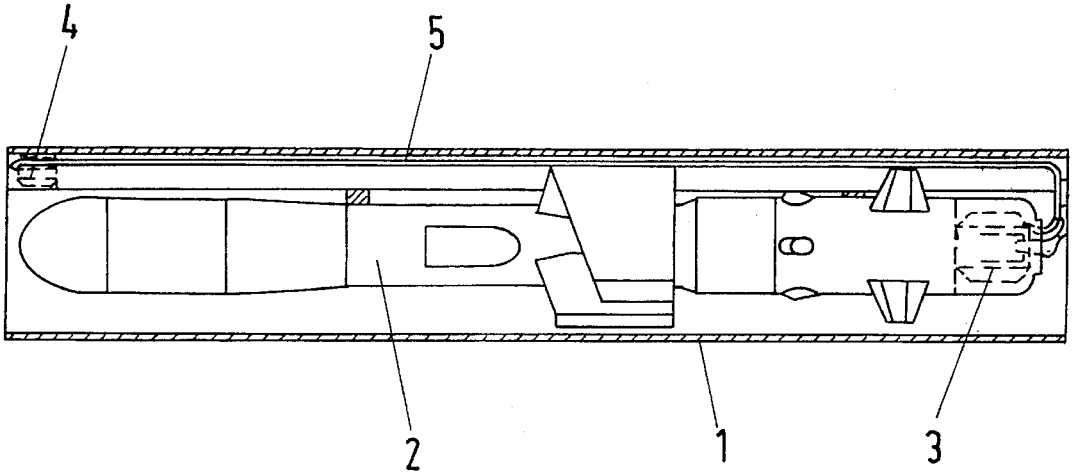
FIG. 1 is a longitudinal sectional view of a launching container with an inserted missile and a displaced optical waveguide.

FIG. 1 is a longitudinal sectional view of a launching container 1, which is also used for the transport of a missile 2 that is conventionally disposed therein. After the launch, the missile 2 (or a torpedo) is controlled by an optical waveguide, of which a portion is wound onto a supply reel (or compensating reel) 4 provided in the forward end in the launching container 1 (that is, at that end through which the missile or torpedo leaves the launching container). The other portion of the optical waveguide is wound onto a supply reel 3 arranged in the missile or torpedo 2 and is carried with it, away from the launching container. The largest portion of the section 5 of the optical waveguide between the two storage reels 3 and 4 extends parallel to the missile 2 on the interior wall of the launching container 1, and is either glued to the interior wall of the launching container, or is held on it by means of a clamping device.

In the case of gluing, the optical waveguide is advantageously held on the interior wall of the launching container by a cotton strip saturated with nitrocellulose which is glued to the interior wall by means of a gluing resin, such as epoxy resin. The burn-off temperature of the cotton strip (which corresponds to a conventional wick) amounts to approximately 1,200°.

Figure 2A:
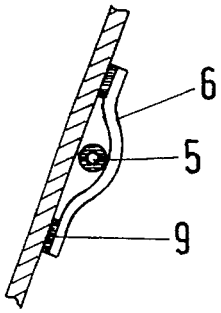
FIGS. 2*a*–2*c* are views of the fastening of the optical waveguide on the interior wall of the launching container by means of a glued arrangement.

FIG. 2 contains three cross-sectional views of that section 5 of the optical waveguide which is held by a glue-type arrangement 6, and extends on the interior wall of the launcher tube. In FIG. 2*a*, the optical waveguide is held by means of a cotton strip which is saturated with nitrocellulose and is fastened on its two longitudinal edges by means of a suitable glue 9, such as epoxy resin, on the interior wall of the launching container.

Figure 2B:
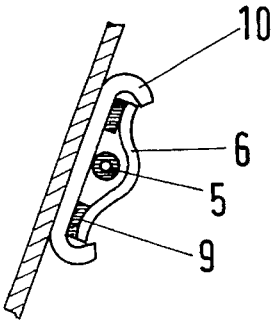
Figure 2C:
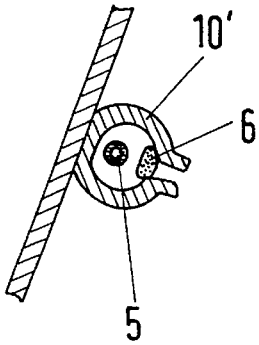

FIGS. 2*b* and 2*c* illustrate alternative gluing arrangements in which a blank holding device 10, 10' is provided between the optical waveguide 5 and the cotton strip 6 with the glue 9 which fixes it, in order to facilitate the mounting of the gluing arrangement.

Figure 3:
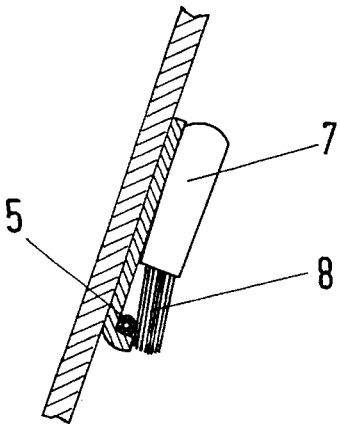
FIGS. 3 and 4 are views of the fastening of the optical waveguide on the interior wall of the launching container with a clamping arrangement.
Figure 4:
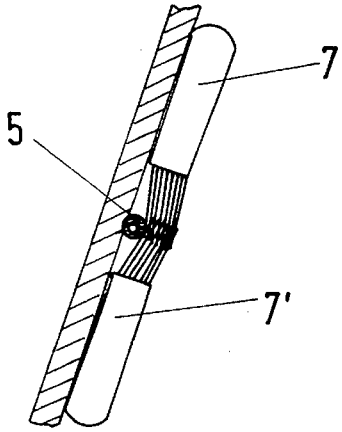

In another alternative embodiment of the apparatus according to the invention, the section 5 of the optical waveguide between the two supply reels 3 and 4 is held on the interior of the launching container by means of a clamping arrangement, as shown in the cross-sectional view in FIGS. 3 and 4. According to FIG. 3, the clamping arrangement consists of an elongated brush 7 which extends parallel to the optical waveguide 5 and whose bristles 8 extend transversely to the longitudinal direction of the optical waveguide. In FIG. 4, two elongated brushes 7, 7' are arranged on both sides in parallel to the optical waveguide 5 in such a manner that their bristles face one another and extend transversely with respect to the longitudinal direction of the optical waveguide 5. In these embodiments, the emerging force can be controlled by a corresponding dimensioning of the brush thickness or of the thickness of the bristles or of their material. By the selection of a corresponding material for the bristles 8, such as glass or metal, the optical waveguide 5 can be protected from the hot exhaust gases of a booster during the launching operation. In this case, the drawing force is largely independent of the environmental conditions prevailing at the launch time. Long-term storage capacity is also ensured in a particularly advantageous manner under all environmental conditions.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An apparatus for the remote control of a vehicle launched from a launching container, comprising:

a cable for transmitting control data to said vehicle;

a first supply reel arranged inside and at a forward end of said launching container, and having a first portion of said cable wound thereon; and a second supply reel arranged at a rearward end of said vehicle and having a second portion of said cable wound thereon; wherein a remaining section of said cable, which extends between said first and second supply reels, is fastened to an interior wall of said launching container by a gluing arrangement which extends along a largest portion of said remaining section; and said gluing arrangement comprises a material which has a combustion temperature that is at least 800° C. lower than a melting temperature of said cable and having a strength sufficient to retain said remaining section fastened to said interior wall during launch of said vehicle.

2. An apparatus according to claim 1 wherein said vehicle is a torpedo.

3. An apparatus according to claim 1 wherein said vehicle is a missile.

4. An apparatus according to claim 1 wherein said cable is an optical waveguide.

5. An apparatus for the remote control of a vehicle launched from a launching container, comprising:

a cable for transmitting control data to said vehicle;

a first supply reel arranged inside and at a forward end of said launching container, and having a first portion of said cable wound thereon; and a second supply reel arranged at a rearward end of said vehicle and having a second portion of said cable wound thereon; wherein a remaining section of said cable, which extends between said first and second supply reels, is fastened to an interior wall of said launching container by a gluing arrangement which extends along a largest portion of said remaining section;

said gluing arrangement comprises a material which has a combustion temperature that is at least 800° C. lower than a melting temperature of said cable; and said gluing arrangement comprises a cotton strip which is saturated with nitrocellulose, and is fastened on the interior of said launching container by means of an adhesive.

6. An apparatus according to claim 5 wherein said adhesive is an epoxy resin.

7. An apparatus according to claim 5 wherein a blank holding device is provided between said gluing arrangement and the interior wall of the launching container.

8. An apparatus for the remote control of a vehicle launched from a launching container, comprising:

a cable for transmitting control data to said vehicle;

a first supply reel arranged inside and at a forward end of said launching container, and having a first portion of said cable wound thereon; and a second supply reel arranged at a rearward end of said vehicle and having a second portion of said cable wound thereon; wherein a remaining section of said cable, which extends between said first and second supply reels, is fastened to an interior wall of said launching container by a flexible clamping arrangement having a holding force sufficient to retain said remaining section fastened to said interior wall during launch of said vehicle, but small enough to release said remaining section if the launching container is moved during travel of said vehicle after launch.

9. An apparatus according to claim 8 wherein said cable is an optical waveguide.

10. An apparatus according to claim 9 wherein said vehicle is a torpedo.

11. An apparatus according to claim 9 wherein said vehicle is a missile.

12. An apparatus for the remote control of a vehicle launched from a launching container, comprising:

a cable for transmitting control data to said vehicle;

a first supply reel arranged inside and at a forward end of said launching container, and having a first portion of said cable wound thereon; and a second supply reel arranged at a rearward end of said vehicle and having a second portion of said cable wound thereon; wherein a remaining section of said cable, which extends between said first and second supply reels, is fastened to an interior wall of said launching container by a flexible clamping arrangement having an adjustable holding force; and the clamping arrangement comprises at least one elongated brush whose bristles extend transversely to a longitudinal axis of said cable.

13. An apparatus according to claim 12 wherein said clamping arrangement comprises two elongated brushes whose bristles extend toward each other, transversely to the longitudinal axis of the cable.

* * * * *